US007222838B1

(12) United States Patent
Ji

(10) Patent No.: US 7,222,838 B1
(45) Date of Patent: May 29, 2007

(54) COLLAPSIBLE VEHICLE RAMP

(76) Inventor: Jun Ji, c/o Torin Jacks, Inc., 4355 E. Brickell St., Ontario, CA (US) 91761

( * ) Notice: Subject to any disclaimer, the term of this patent is extended or adjusted under 35 U.S.C. 154(b) by 0 days.

(21) Appl. No.: 11/360,556

(22) Filed: Feb. 22, 2006

(51) Int. Cl.
*E02C 3/00* (2006.01)

(52) U.S. Cl. ..... 254/88

(58) Field of Classification Search ..... 254/88, 254/94; 14/69.5; 248/188.2, 352; 188/32
See application file for complete search history.

(56) References Cited

U.S. PATENT DOCUMENTS 1,819,450 A * 8/1931 Weller ..... 254/88
1,904,693 A * 4/1933 Fayette et al. ..... 254/88
3,994,474 A * 11/1976 Finkbeiner ..... 254/88
4,013,268 A * 3/1977 Williams ..... 254/88
4,058,292 A * 11/1977 Goodrich et al. ..... 254/88
4,327,896 A * 5/1982 Whitehead ..... 254/88
6,517,051 B1 * 2/2003 Cavanaugh ..... 254/88

* cited by examiner

*Primary Examiner*—Lee D. Wilson
(74) *Attorney, Agent, or Firm*—Ladas & Parry LLP

(57) ABSTRACT

An improvement in a vehicle ramp facilitates easy storage and quick and simple conversion from a stored, collapsed state to an open, in-use state. The vehicle ramp comprises a pair of plate members pivotally coupled together along one side of each respective plate member which, being supported by a frame arrangement articulately connected to the plate members, permits the plate members to be selectively pivoted with respect to one another to either form a functional raised vehicle ramp configuration, or form a storable, collapsed, low profile configuration in which the two plate members lie in substantially a common plane, along with the articulated frame arrangement.

7 Claims, 7 Drawing Sheets

COLLAPSIBLE VEHICLE RAMP

REFERENCE TO DISCLOSURE DOCUMENT CERTIFICATE

Reference is made to U.S. Disclosure Document Certificate No. 587734, recorded Oct. 5, 2005, entitled "Foldable Car Ramp". The entire contents of such disclosure document is incorporated herein by reference.

BACKGROUND OF THE INVENTION

1. Field of the Invention

This invention is related to the field of vehicle accessories, and more particularly to a device for supporting the wheels of a vehicle in a raised position, primarily to permit inspection, repair, and/or maintenance of the underside of the vehicle.

2. Brief Description of the Prior Art

Prior art vehicle ramps are generally in the nature of a fixed structure of steel plates and connecting steel braces.

An example of such a prior art vehicle ramp is a structure that comprises a sloping metal plate welded to a raised horizontal plate, with a steel frame welded, or otherwise secured, to the rear of the raised horizontal plate, and to the front sides of the sloped plate.

There are a number of prior art folding vehicle ramps, most of which fold along a longitudinal center of the ramp, and, in the unfolded condition, are simply a flat, or bowed rectangular surface end-to-end.

One prior art vehicle ramp is foldable, but the sloped ramp and horizontal wheel supporting plates are permanently joined together, as by welding, and is foldable only to the extent that the unitary ramp and wheel support plate folds relative to the frame that supports it. As a result, even in the folded condition, the device is bulky and occupies a significant amount of storage space in a garage, or in the trunk of a vehicle.

Accordingly, there is a need in the art for an improved vehicle ramp that is fully collapsible to occupy a minimum amount of storage space.

SUMMARY OF THE INVENTION

The present invention provides a vehicle ramp comprising a pair of plate members, pivotally connected together along respective edges thereof. A frame arrangement is articulately connected to the plate members, whereby the plate members can be selectively pivoted with respect to one another to either form a functional raised in-use vehicle ramp configuration, or form a storable, collapsed, low profile configuration in which the two plate members lie in substantially a common plane.

In a preferred embodiment, there is provided a vehicle ramp comprising a first plate member having a front end and a rear end, and a second plate member having a front end and a rear end. The rear end of the second plate member is pivotally connected to the front end of the first plate member. A frame arrangement, comprised of a plurality of interconnected articulated support members is provided, coupled to the first and second plate members, to permit collapsing the entire assembly from a raised in-use position.

BRIEF DESCRIPTION OF THE DRAWING

Further objects and advantages and a better understanding of the present invention may be had by reference to the following detailed description taken in conjunction with the accompanying drawings in which.

DETAILED DESCRIPTION OF THE PREFERRED EMBODIMENTS

Figure 1:
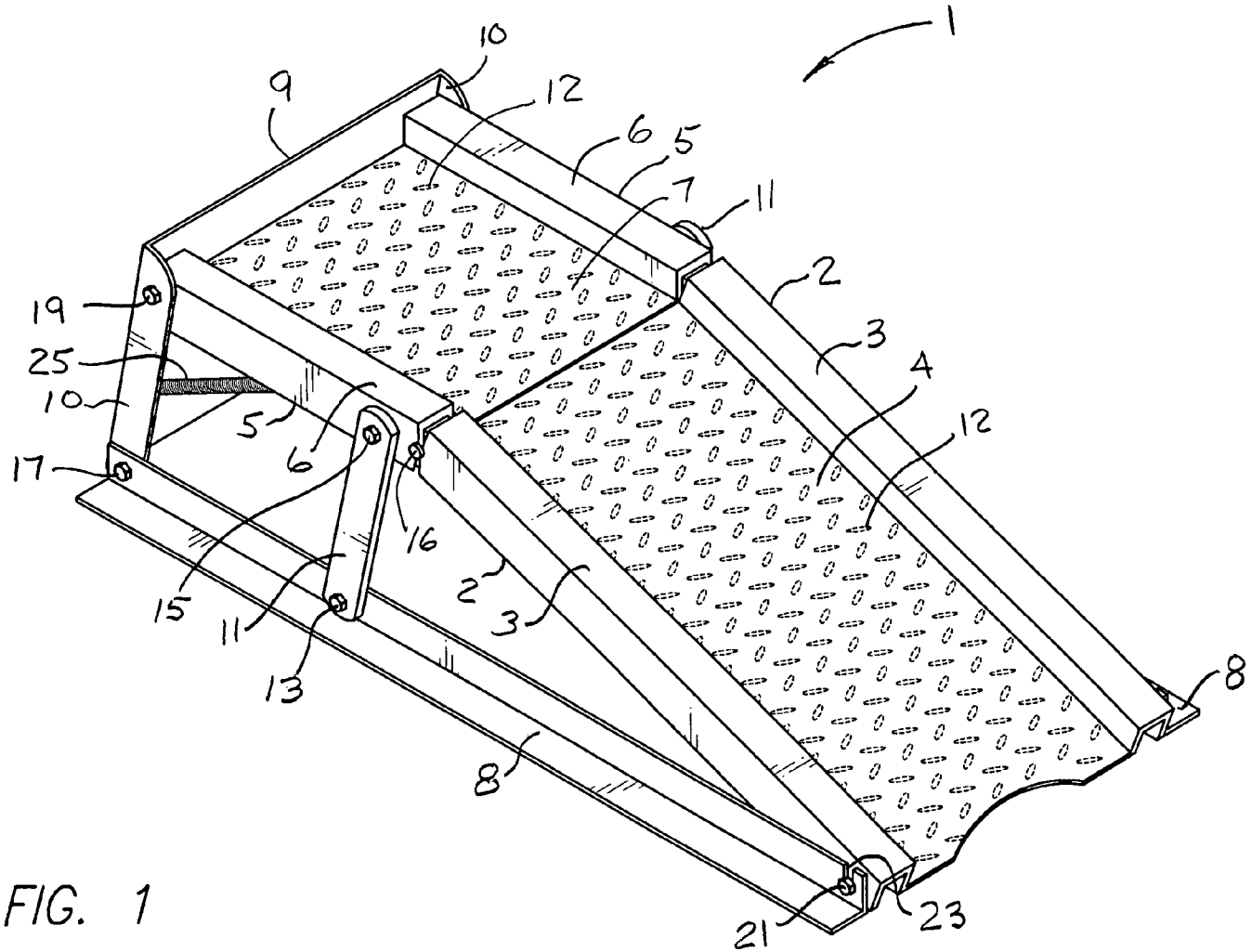
FIG. 1 is a perspective view of a collapsible vehicle ramp, shown in the raised, or in-use, condition, constructed in accordance with a preferred embodiment of the present invention.

In FIG. 1, the collapsible vehicle ramp 1 is shown, in perspective representation, in its raised, or in-use configuration.

A riser plate member 2, hereinafter referred to as riser 2, extends from a reference surface, assumed to be the ground or floor in most cases, to an elevated level, leading to elevated wheel platform plate member 5, hereinafter referred to as platform 5.

Riser 2 comprises a flat friction plate portion 4 extending between a pair of parallel, U-shaped, raised, riser side channels 3.

Platform 5 also comprises a flat friction plate portion 7 extending between a pair of U-shaped platform side channels 6.

It will be understood that the raised diamond grip elements 12, on the two flat friction plate portions 4 and 7, are exemplary only of a frictional surface texture, are not necessarily shown to scale, and may not be depicted in the drawing as they would appear on the actual device.

In a preferred embodiment, the plate portion 4 and side channels 3 of the riser 2 are integrally formed as a unitary structure. Similarly, the plate portion 7 and side channels 6 of the platform 5 are integrally formed as a unitary structure.

An articulated frame structure 8-11 is preferably comprised of a pair of parallel, spaced-apart, horizontal angle iron base support members 8, a back plate 9 with side flanges 10, and a pair of parallel, spaced-apart, pivotable, vertical support members 11.

Support members 11 are pivotally attached to respective base support members 8 by means of bolt and nut arrangements 13, and similarly pivotally attached to the side channels 6 by means of bolt and nut arrangements 15.

The side flanges 10 of back plate 9 are pivotally attached to respective base support members 8 by means of bolt and nut arrangements 17, and similarly pivotally attached to the side channels 6 by means of bolt and nut arrangements 19.

Each bolt and nut arrangement 13, 15, 17, 19 has a limited tightening span, and may have loose spacer sleeves to assist in aligning up the individual members of the articulated frame structure 8-11, noting that the bottom of flanges 10 fit inside the vertical wall of horizontal base support member 8, while vertical support members 11 fit on the outside.

A stud, preferably in the form of a bolt and nut combination 21, is fixed adjacent the front end of riser 2 and is sized and shaped to fit snugly into a slot 23 formed in the front end of horizontal base support member 8. In the raised in-use configuration of the vehicle ramp shown in FIG. 1, stud 21 is captured by, and securely retained in, slot 23, due, in part, to the gravitational pull downwardly of the heavy steel riser 2, and due, in part, to the tension in springs 25 (to be described in detail hereinafter).

Figure 2:
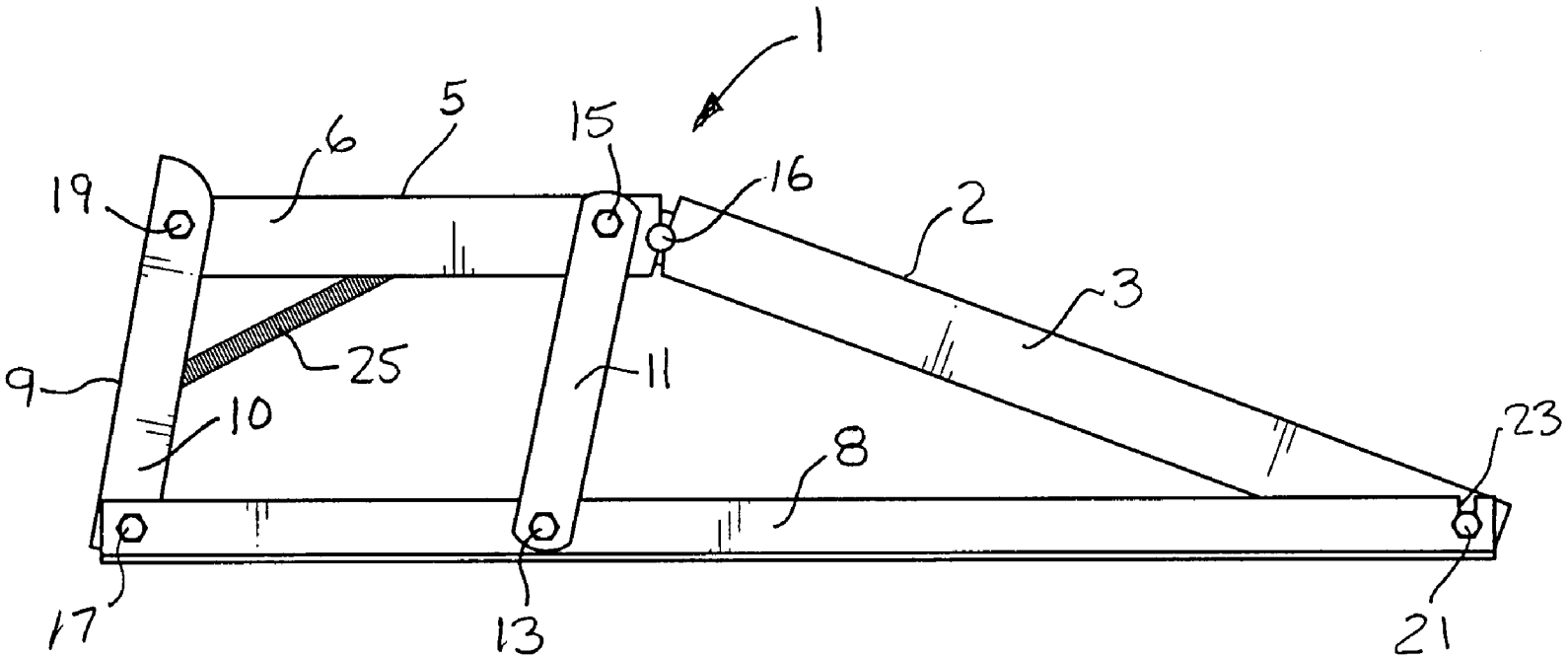
FIG. 2 is a right side elevation view of the collapsible vehicle ramp shown in FIG. 1, the left side elevation view being a mirror image thereof.

FIG. 2 is a right side elevation view of the collapsible vehicle ramp 1 shown in FIG. 1, the left side elevation view being a mirror image thereof. In this view, it will be noted that the vertical support member 11 and back plate 9 lean slightly forward. This is intentional, as this configuration of the elements of the ramp 1 increases the stability of the raised, in-use, vehicle ramp 1. If the vertical support member 11 and back plate 9, in the raised configuration, were vertical, there may be a tendency for the ramp 1 to collapse under the weight of the vehicle on the platform 5.

Figure 4:
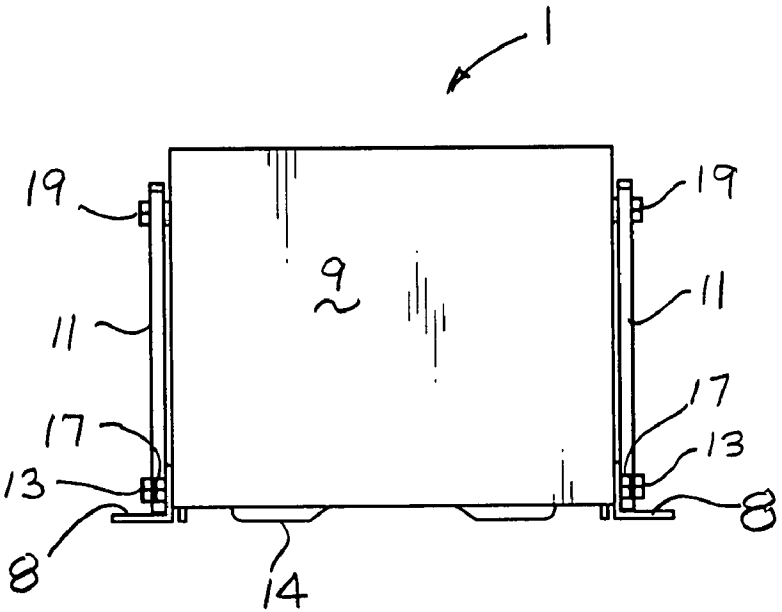
FIG. 4 is a rear elevation view of the collapsible vehicle ramp shown in FIG. 1.
Figure 3:
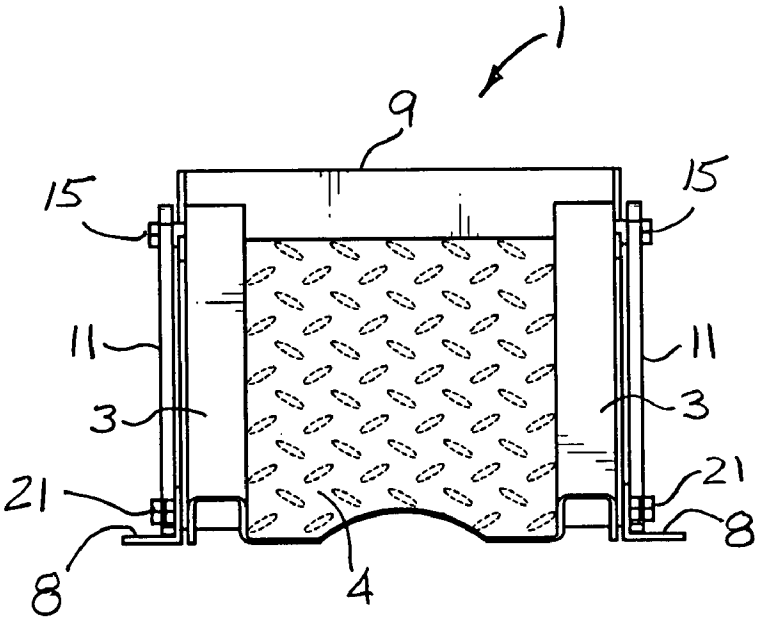
FIG. 3 is a front elevation view of the collapsible vehicle ramp shown in FIG. 1.

FIGS. 3 and 4 are, respectively, a front elevation view and a rear elevation view of the collapsible vehicle ramp 1 shown in FIG. 1. In these views, it will be observed that the bolt and nut arrangements 13, 15, 17, 19 are designed and selected to allow free pivoting of the articulated frame structure 8-11 with the platform 5.

Figure 5:
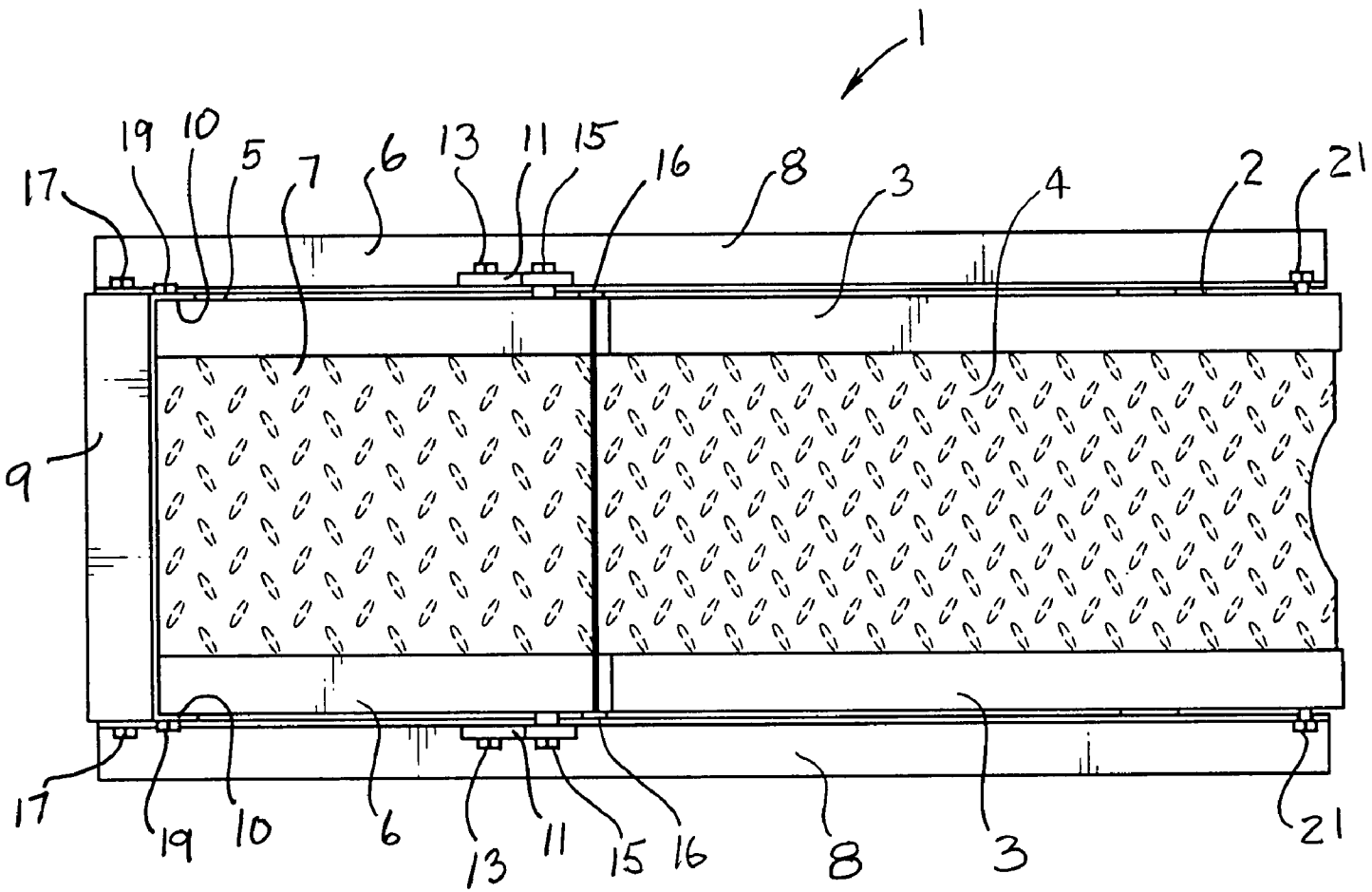
FIG. 5 is a top plan view of the collapsible vehicle ramp shown in FIG. 1.

FIG. 5 is a top plan view of the collapsible vehicle ramp shown in FIG. 1.

Figure 6:
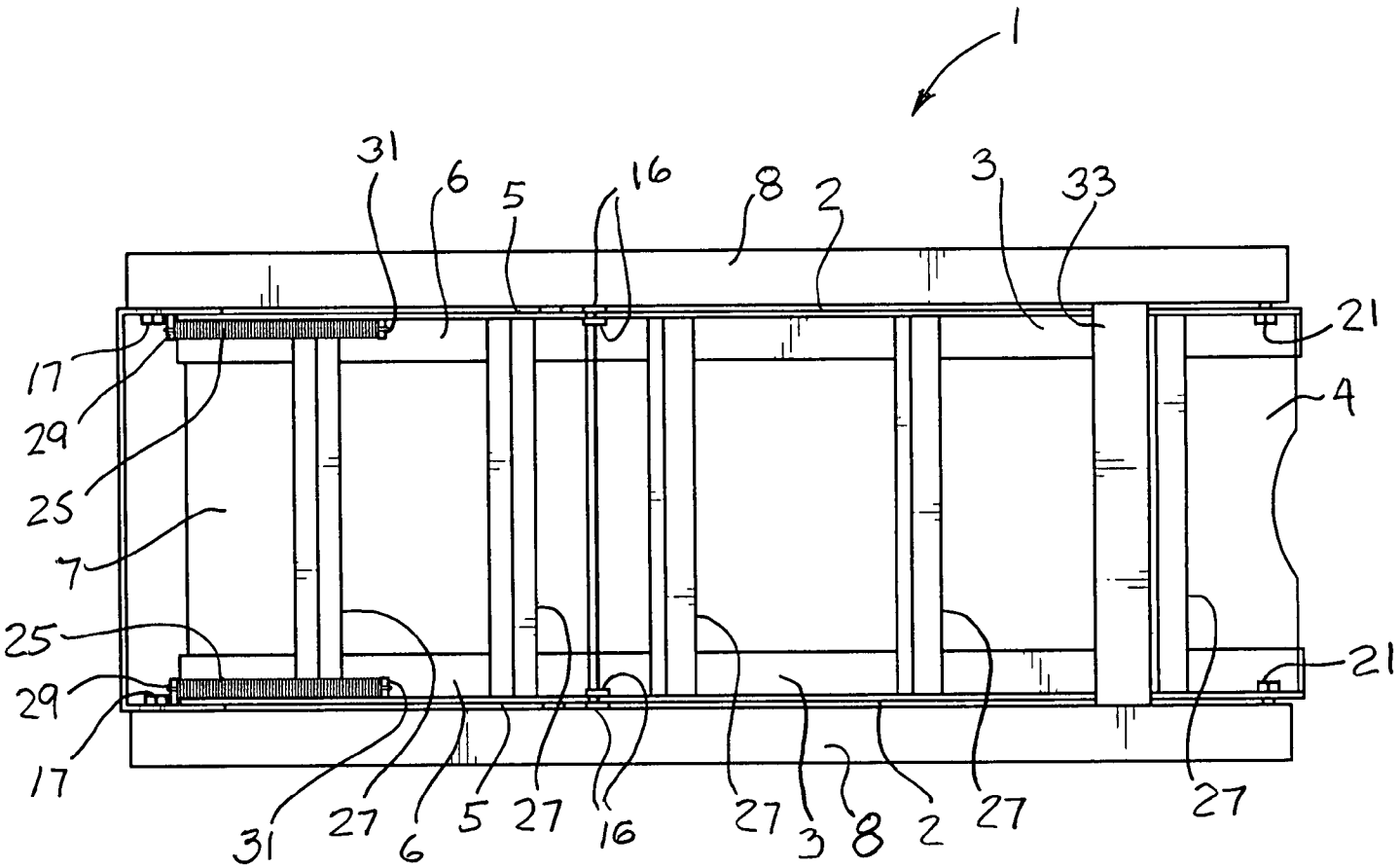
FIG. 6 is a bottom view of the collapsible vehicle ramp shown in FIG. 1.

FIG. 6 is a bottom view of the collapsible vehicle ramp shown in FIG. 1, revealing a number of small angle iron ribs 27. Preferably, ribs 27 are welded, at each end of each rib 27, to the outer walls of channels 3 and 6, and welded, adjacent each end of each rib 27, to the underside of the flat riser friction plate portions 4 and 7.

Also, as seen in FIG. 6, a pair of tension springs 25 are provided. Each spring 25 is attached to, and stretched between, respective ones of a pair of laterally projecting studs 29 on back plate 9 and side channels 6.

In FIG. 6, a steel stabilizing strap 33 is shown, welded at its ends to horizontal support members 8, for rigidly coupling the free ends of horizontal support members 8 together at the proper spacing.

Springs 25 are in their relaxed state, since the vehicle ramp 1 is shown in its raised in-use configuration. It thus can be appreciated that the springs 25 assist in biasing the ramp 1 to get into, and stay in, the raised in-use configuration, a key safety feature of the invention.

As best understood by referencing FIGS. 2 and 6, when stud 21 is withdrawn from slot 23, and a forwardly directed force is applied to the top of back plate 9, springs 25 will be tensioned as the platform 5 moves forward, until the ramp 1 is in its fully collapsed configuration. In this condition, the springs 25, although fully tensioned, are substantially parallel to the linearly aligned riser 2 and platform 5, and therefore pull against a rigid resistance presented by the structure. With appropriate placement of the projecting studs 29, 31, defining an over-center condition when the ramp 1 is in the collapsed configuration, the springs 25 will act to pull back plate 9 toward the front of the ramp 1, and keep the ramp 1 in the collapsed condition.

When back plate 9 is lifted a small amount, from the collapsed condition of the ramp 1, the springs 25 again act to pull the back plate 9 and platform 5 together and force the structure to a raised in-use condition.

Figure 7:
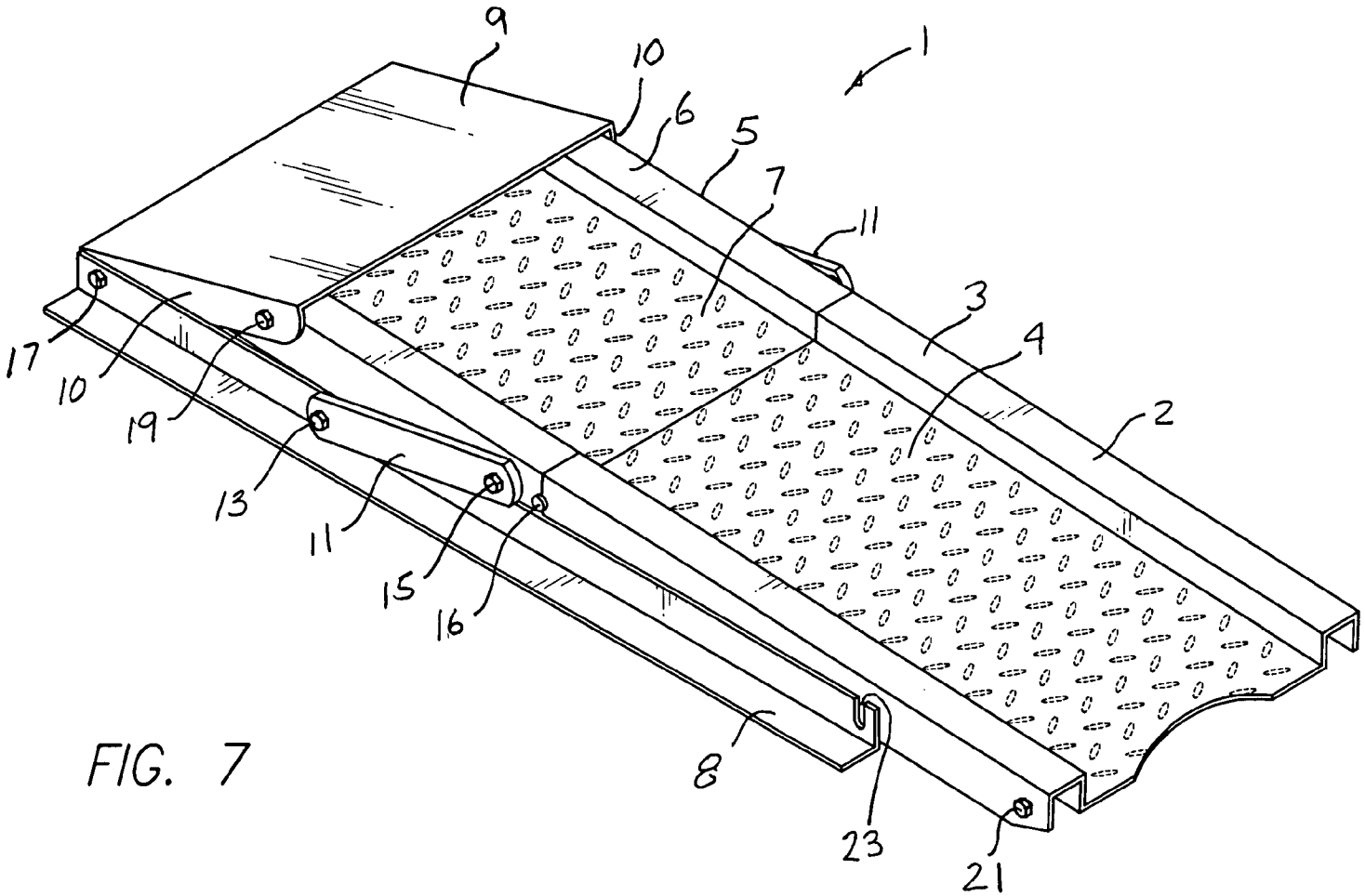
FIG. 7 is a perspective view of a collapsible vehicle ramp, shown in the collapsed condition, constructed in accordance with a preferred embodiment of the present invention.
Figure 8:
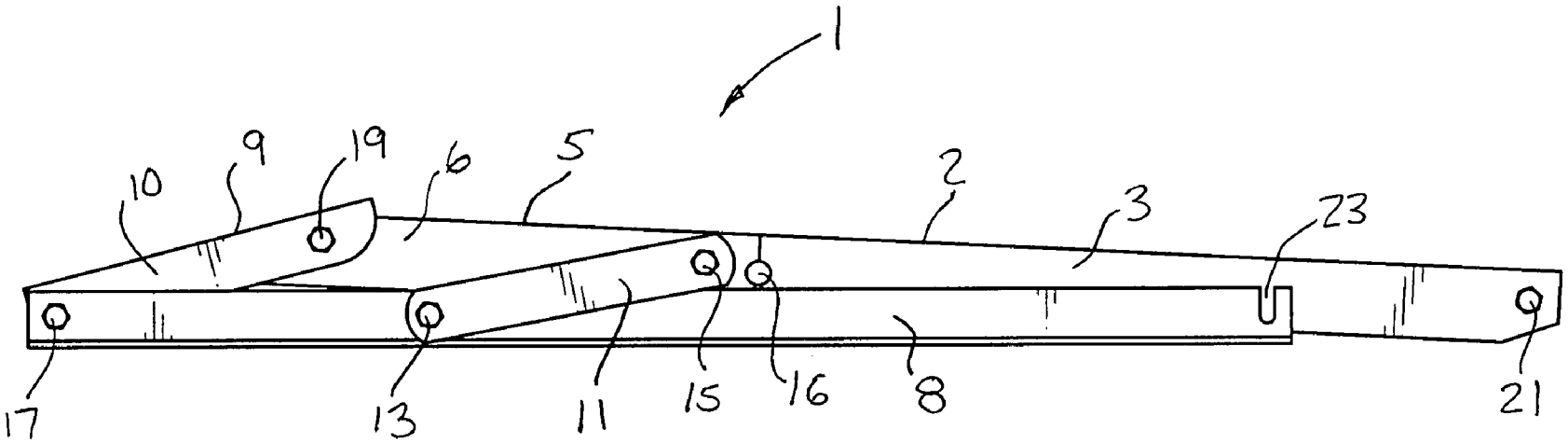
FIG. 8 is a right side elevation view of the collapsible vehicle ramp shown in FIG. 7, the left side elevation view being a mirror image thereof.

FIG. 7 is a perspective view of the collapsible vehicle ramp 1, shown in the collapsed condition; and FIG. 8 is a right side elevation view of the collapsible vehicle ramp 1 shown in FIG. 7, the left side elevation view being a mirror image thereof.

While only certain embodiments have been set forth, alternative embodiments and various modifications will be apparent from the above description to those skilled in the art. These and other alternatives are considered equivalents and within the spirit and scope of the present invention.

What is claimed is:

1. A vehicle ramp comprising:

a first plate member having a front end and a rear end;

a second plate member having a front end and a rear end, said rear end of said second plate member pivotally connected to said front end of said first plate member; and a frame arrangement comprised of a plurality of interconnected articulated support members, an end of a first support member pivotally connected adjacent said first plate member rear end, an end of a second support member pivotally connected adjacent said front end of said first plate member, and a third support member, articulated to both said first and second support members, being releasably attached to said second plate member front end, wherein:

said second plate member front end has a latching stud projecting laterally of said second plate member front end; and a slot is formed in said third support member, sized and adapted to capture said latching stud within said slot when said third support member is releasably attached to said second plate member front end.

2. The vehicle ramp as claimed in claim 1, wherein:

said first support member has a first laterally projecting retaining stud intermediate ends of said first supporting member;

said first plate member has a second laterally projecting retaining stud intermediate ends of said first plate member; and said vehicle ramp comprises a tension spring retained between said first and second laterally projecting studs, said spring experiencing increased tension as said vehicle ramp changes from a collapsed configuration to an elevated configuration.

3. The vehicle ramp as claimed in claim 2, wherein:

when said latching stud is withdrawn from said slot, and a forwardly directed force is applied to the top of said first support member, said tension spring is tensioned as said first plate member moves forward, until said first and second plate members are in their fully collapsed condition; and when said forwardly directed force is released form the top of said first support member, said tension spring acts to draw said first support member and said first said first plate member together, thereby tending to expand said vehicle ramp to its raised in-use configuration.

4. The vehicle ramp as claimed in claim 2, wherein:

said first plate member comprises an underside lateral rib; and said laterally projecting retaining studs are positioned such that they form an over-center arrangement, relative to said rib, whereby, when said first and second plate members are in a collapsed condition, said spring will act to pull said first support member downwardly and toward the front of said second plate member tending to keep said vehicle ramp in the collapsed configuration.

5. A vehicle ramp comprising:

a first plate member having a front end and a rear end;

a second plate member having a front end and a rear end, said rear end of said second plate member pivotally connected to said front end of said first plate member; and a frame arrangement comprised of a plurality of interconnected articulated support members, an end of a first support member pivotally connected adjacent said first plate member rear end, an end of a second support member pivotally connected adjacent said front end of said first plate member, and a third support member, articulated to both said first and second support members, being releasably attached to said second plate member front end, wherein:

said second plate member front end has a latching stud projecting laterally of said second plate member front end;

a slot is formed in said third support member, sized and adapted to capture said latching stud within said slot when said third support member is releasably attached to said second plate member front end; and said third support member is released from attachment to said second plate member when said latching stud is withdrawn from said slot.

6. The vehicle ramp as claimed in claim 5, wherein, with said latching stud withdrawn from said slot:

said first and second plate members pivot relative to each other to lie substantially in a common plane adjacent said reference surface, thereby defining a collapsed and storable configuration of said vehicle ramp.

7. A vehicle ramp comprising:

a first plate member having a front end and a rear end;

a second plate member having a front end and a rear end, said rear end of said second plate member pivotally connected to said front end of said first plate member; and a frame arrangement comprised of a plurality of interconnected articulated support members, an end of a first support member pivotally connected adjacent said first plate member rear end, an end of a second support member pivotally connected adjacent said first plate member rear end, an end of a second support member pivotally connected adjacent said front end of said first plate member, and a third support member, articulated to both said first and second support members, being releasably attached to said second plate member front end, wherein:

said second plate member front end has a first securing component; and said third support member has disposed thereon a second securing component, said second securing component sized and adapted to securely couple with said first securing component when said third support member is releasably attached to said second plate member front end.

* * * * *